US010343182B2

(12) United States Patent
Pringle, IV et al.

(10) Patent No.: US 10,343,182 B2
(45) Date of Patent: Jul. 9, 2019

(54) DISPENSING UNITS FOR CONTROLLING SUBSTANCE FLOW AND RELATED METHODS

(71) Applicant: The Boeing Company, Chicago, IL (US)

(72) Inventors: John Walter Pringle, IV, Huntington Beach, CA (US); Jose G. Trujillo Rojas, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/464,510

(22) Filed: Mar. 21, 2017

(65) Prior Publication Data

US 2018/0272372 A1 Sep. 27, 2018

(51) Int. Cl.

| | |
|---|---|
| ***B05C 5/02*** | (2006.01) |
| ***B05C 11/10*** | (2006.01) |
| *B05B 1/30* | (2006.01) |

(52) U.S. Cl.

CPC ..... *B05C 5/0229* (2013.01); *B05C 11/1007* (2013.01); *B05C 11/1013* (2013.01); *B05B 1/3066* (2013.01); *B05C 11/10* (2013.01)

(58) Field of Classification Search

CPC ..... B05C 11/1007; B05C 11/1013; B05C 5/0225; B05C 5/0229; F16K 5/0414

See application file for complete search history.

(56) References Cited

U.S. PATENT DOCUMENTS 2,090,232 A * 8/1937 Ritz ..... F02M 61/10 137/242
3,783,900 A * 1/1974 Waldbillig ..... F16K 11/0853 137/625.47

(Continued)

FOREIGN PATENT DOCUMENTS

| | | | |
|---|---|---|---|
| GB | 479677 A * | 2/1938 | ..... B05B 1/042 |
| WO | 9847623 | 10/1998 | |
| WO | 2015039129 | 3/2015 | |

OTHER PUBLICATIONS

European Patent Office, "Extended European Search Report," issued in connection with European Patent Application No. 18162837.1, dated Aug. 8, 2018, 8 pages.

(Continued)

*Primary Examiner* — David P Angwin
*Assistant Examiner* — Bob Zadeh
(74) *Attorney, Agent, or Firm* — Hanley, Flight & Zimmerman, LLC

(57) ABSTRACT

A dispensing unit (100) for controlling flow of a substance (101) comprises a nozzle (102) and a plug (110). The nozzle comprises an outlet (122) and a channel (104) that comprises a longitudinal symmetry axis (130), a sealing surface (106), and an alcove surface (108), contiguous with the sealing surface (106) and outwardly recessed relative to the sealing surface (106); and a plug (110). The plug (110) comprises a wall (112) that comprises an outer surface (114) and that also comprises a first aperture (116), fully penetrating the wall (112) through the outer surface (114) of the wall (112) of the plug (110). The outer surface (114) of the wall (112), comprising the first aperture (116), is complementary with the sealing surface (106) of the channel (104). The plug (110) is movable in the channel (104).

37 Claims, 11 Drawing Sheets

(56) References Cited

U.S. PATENT DOCUMENTS

| | | | | |
|---|---|---|---|---|
| 4,275,868 | A | 6/1981 | Crone | |
| 5,277,342 | A | 1/1994 | Dickau et al. | |
| 5,558,504 | A * | 9/1996 | Stridsberg | B05B 12/124 417/322 |
| 5,794,825 | A | 8/1998 | Gordon et al. | |
| 5,832,959 | A * | 11/1998 | Szymczakowski | A61M 39/223 137/556 |
| 6,196,477 | B1 | 3/2001 | Halltorp et al. | |
| 6,643,864 | B1 | 11/2003 | Tse | |
| 6,843,466 | B1 | 1/2005 | Chuang | |
| 7,347,407 | B2 | 3/2008 | Chen | |
| 8,146,883 | B2 * | 4/2012 | O'Hara | F16K 1/48 251/291 |
| 2002/0084437 | A1 * | 7/2002 | Nitsche | F16K 5/0414 251/309 |
| 2006/0243758 | A1 | 11/2006 | Parks et al. | |
| 2008/0035225 | A1 | 2/2008 | Tackes et al. | |
| 2009/0159728 | A1 * | 6/2009 | Suzuki | F02M 51/0671 239/584 |
| 2012/0043353 | A1 | 2/2012 | Davideit et al. | |
| 2014/0326760 | A1 | 11/2014 | Topf et al. | |
| 2016/0004257 | A1 * | 1/2016 | Fliess | F16K 51/00 137/1 |
| 2016/0010564 | A1 | 1/2016 | Lior et al. | |
| 2016/0228890 | A1 * | 8/2016 | Votteler | B05B 1/265 |
| 2018/0272372 | A1 * | 9/2018 | Pringle, IV | B05C 11/1007 |

OTHER PUBLICATIONS

United Stated Patent and Trademark Office, "Non-Final Office Action," issued in connection with US. Appl. No. 15/464,597, dated Jan. 28, 2019, 37 pages.

* cited by examiner

DISPENSING UNITS FOR CONTROLLING SUBSTANCE FLOW AND RELATED METHODS

TECHNICAL FIELD

The present disclosure relates to dispensing units for controlling substance flow and to related methods.

BACKGROUND

Wings of aircraft may be sealed to form a fuel chamber(s). The substance used to seal the fuel chamber(s) may be a viscous sealant. However, other substances may be used. Regardless of the substance used to seal the fuel chamber(s), in some examples, sealing the fuel chamber(s) may be challenging based on the area being a confined space.

SUMMARY

Accordingly, apparatuses and methods, intended to address at least the above-identified concerns, would find utility.

The following is a non-exhaustive list of examples, which may or may not be claimed, of the subject matter according to the invention.

One example of the subject matter according to the invention relates to a dispensing unit for controlling flow of a substance. The dispensing unit comprises a nozzle and a plug. The nozzle comprises an outlet and a channel that comprises a longitudinal symmetry axis, a sealing surface, and an alcove surface, contiguous with the sealing surface and outwardly recessed relative to the sealing surface. The plug comprises a wall that comprises an outer surface and that also comprises a first aperture, fully penetrating the wall through the outer surface of the wall of the plug. The outer surface of the wall, comprising the first aperture, is complementary with the sealing surface of the channel. Plug is movable in the channel.

Defining first aperture in wall of plug enables flow of substance through first aperture of plug. Forming sealing surface of channel of nozzle and outer surface of wall of plug as complimentary to one another enables an interaction between sealing surface of channel of nozzle and wall of plug to prevent and/or stop the flow of substance out of first aperture of plug and nozzle.

Another example of the subject matter according to the invention relates to a method of controlling flow of a substance through a nozzle, having a channel terminating in an outlet. The method comprises at least one of: positioning a plug, comprising a wall, along the channel such that a sealing surface of the channel prevents the substance from flowing through a first aperture that penetrates the wall of the plug through an outer surface of the wall, wherein the outer surface of the wall of the plug is complementary with the sealing surface of the channel of the nozzle; positioning the plug along the channel such that the sealing surface of the channel prevents the substance from flowing through a portion of the first aperture in the wall of the plug; and positioning the plug along the channel such that the sealing surface of the channel does not prevent the substance from flowing through any portion of the first aperture in the wall of the plug.

Moving plug to an upper location (e.g., a snuff-back location) at which sealing surface of channel of nozzle fully covers first aperture of plug prevents a flow of substance through first aperture of plug. Moving plug to a location at which sealing surface of channel of nozzle partially covers first aperture of plug enables a flow of substance through a portion of first aperture of plug. Moving plug to a location spaced from sealing surface of channel of nozzle enables a flow of substance through first aperture of plug.

BRIEF DESCRIPTION OF THE DRAWINGS

Having thus described one or more examples of the invention in general terms, reference will now be made to the accompanying drawings, which are not necessarily drawn to scale, and wherein like reference characters designate the same or similar parts throughout the several views, and wherein:

FIG. 1 is a block diagram of a dispensing unit, according to one or more examples of the present disclosure;

FIG. 2 is a schematic, perspective view of an example implementation of the dispensing unit of FIG. 1, according to one or more examples of the present disclosure;

FIG. 3 is a schematic, cross-sectional view of the dispensing unit of FIG. 2, according to one or more examples of the present disclosure;

FIG. 4 is a schematic, cross-sectional view of a portion of the dispensing unit of FIG. 2, according to one or more examples of the present disclosure;

FIG. 5 is a schematic, cross-sectional view of a portion of the dispensing unit of FIG. 2, according to one or more examples of the present disclosure;

FIG. 6 is a schematic, cross-sectional view of a portion of the dispensing unit of FIG. 2, according to one or more examples of the present disclosure;

FIG. 7 is a schematic of a portion of the dispensing unit of FIG. 2, according to one or more examples of the present disclosure;

FIG. 8 is a schematic, cross-sectional view of a portion of the dispensing unit of FIG. 2, according to one or more examples of the present disclosure;

FIG. 9 is a block diagram of a method of utilizing the dispensing unit of FIG. 1, according to one or more examples of the present disclosure;

FIG. 10 is a block diagram of aircraft production and service methodology; and FIG. 11 is a schematic illustration of an aircraft.

DETAILED DESCRIPTION

Figure 1:
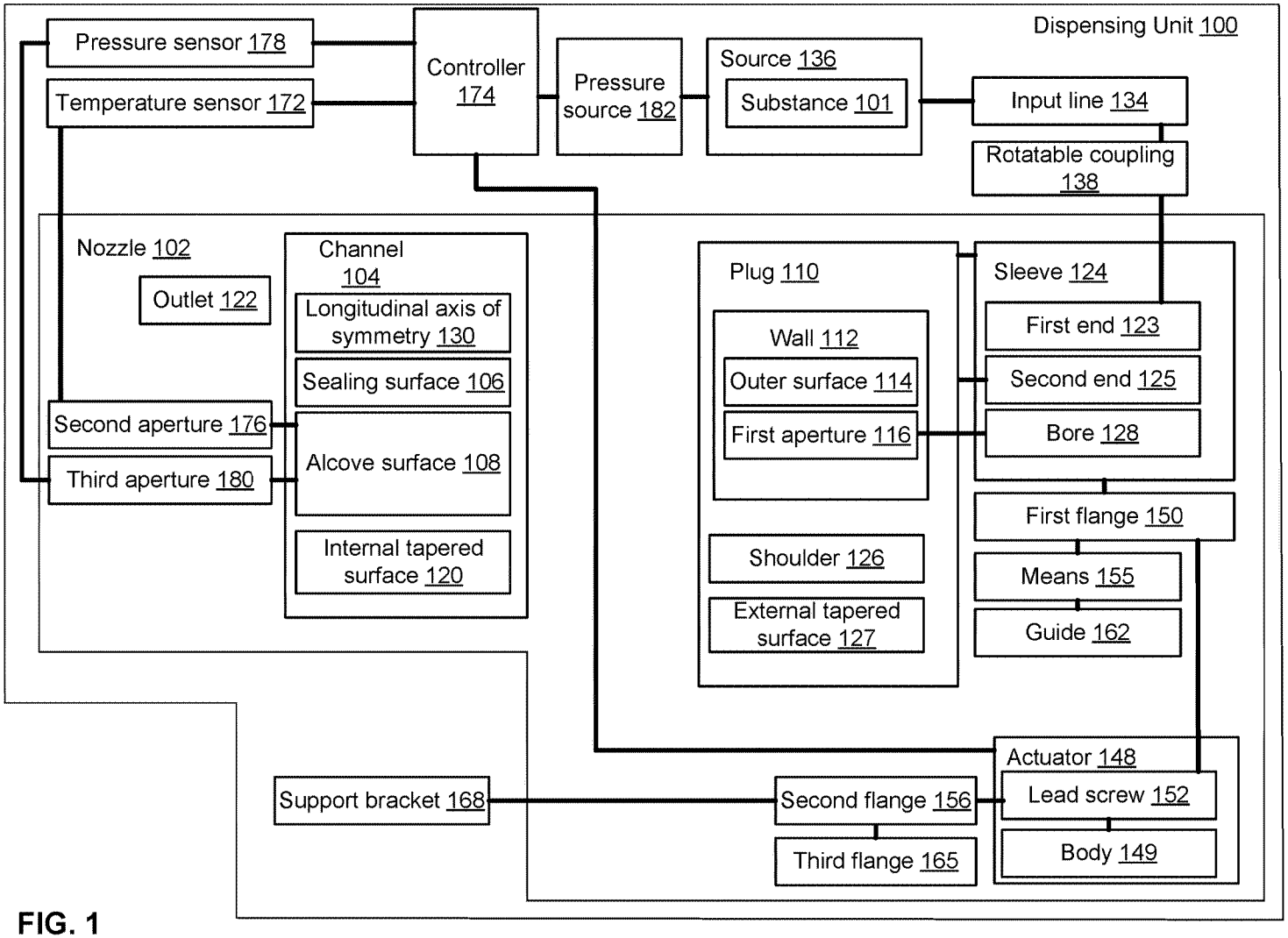

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

Figure 10:
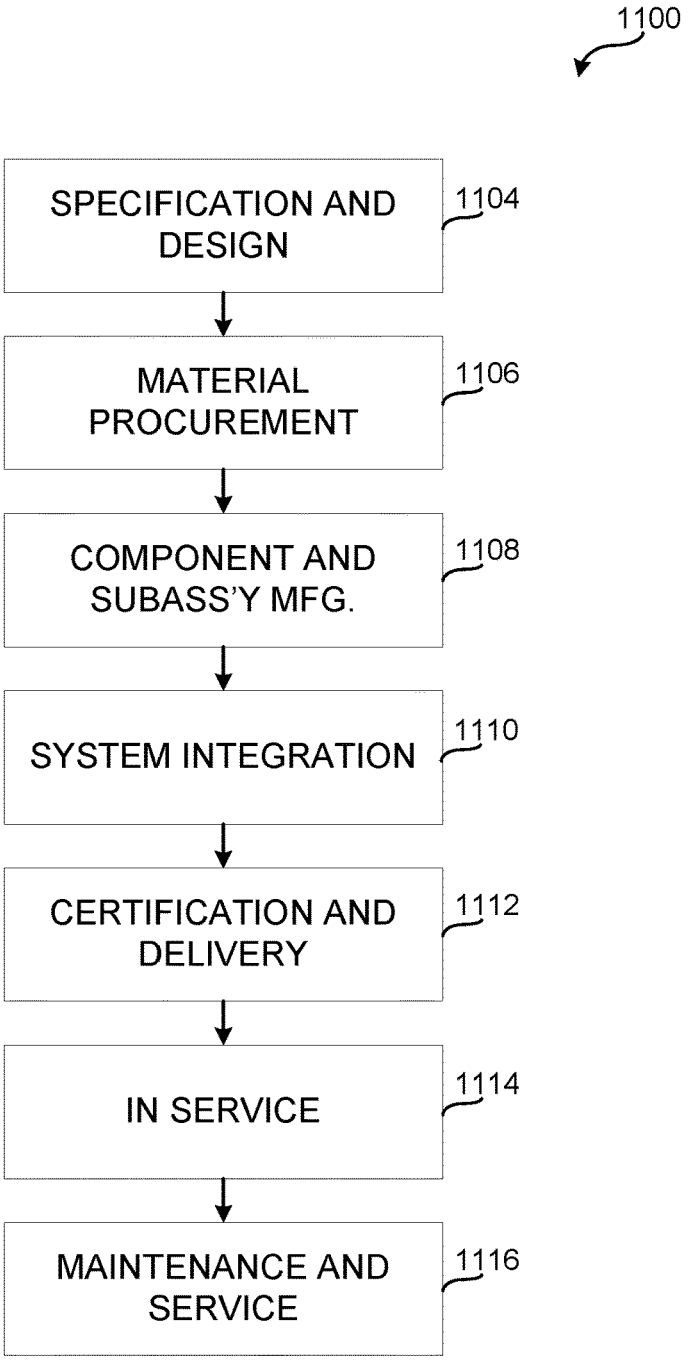
Figure 11:
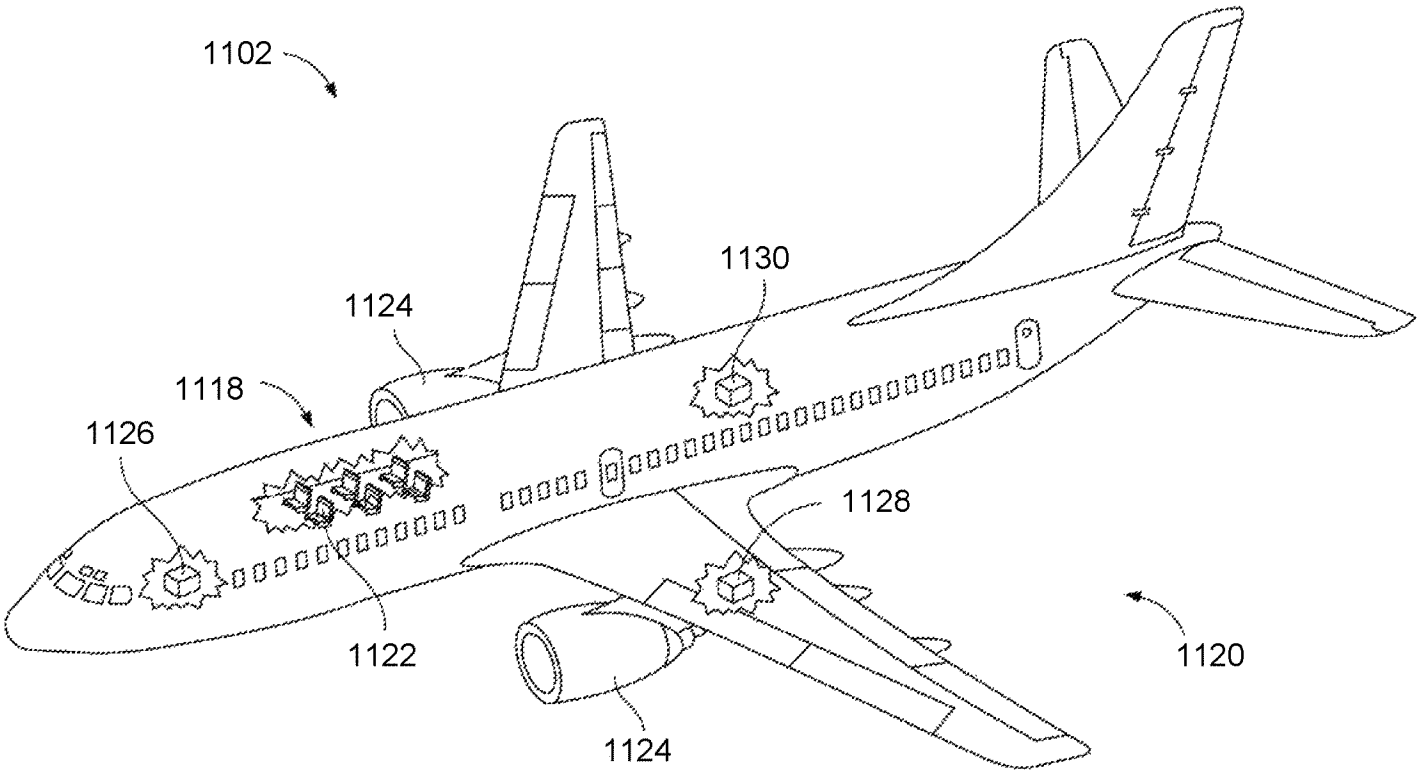

In FIGS. 10 and 11, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 10 and 11 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Referring generally to FIG. 1 and particularly to, e.g., FIGS. 2-8, a dispensing unit 100 for controlling flow of substance 101 is disclosed. Dispensing unit 100 comprises nozzle 102 and plug 110. Nozzle 102 comprises outlet 122 and channel 104 that comprises longitudinal symmetry axis 130, sealing surface 106, and alcove surface 108, contiguous with sealing surface 106 and outwardly recessed relative to sealing surface 106. Plug 110 comprises wall 112 that comprises outer surface 114 and that also comprises first aperture 116, fully penetrating wall 112 through outer surface 114 of wall 112 of plug 110. Outer surface 114 of wall 112, comprising first aperture 116, is complementary with sealing surface 106 of channel 104. Plug 110 is movable in channel 104. The preceding subject matter of this paragraph characterizes example 1 of the present disclosure.

Defining first aperture 116 in wall 112 of plug 110 enables flow of substance 101 through first aperture 116 of plug 110. Forming sealing surface 106 of channel 104 of nozzle 102 and outer surface 114 of wall 112 of plug 110 as complimentary to one another enables an interaction between sealing surface 106 of channel 104 of nozzle 102 and wall 112 of plug 110 to prevent and/or stop the flow of substance 101 out of first aperture 116 of plug 110 and nozzle 102.

The examples disclosed herein relate to nozzles and/or end effectors that may be used with robotic systems to dispense substances. Some substances that may be dispensed include sealant. However, any substance may be dispensed using the example nozzles disclosed herein. In some examples, these nozzles and/or end-effectors (e.g., end of arm attachments) are used to dispense substances in confined spaces such as, for example, within the interior of an aircraft wing (e.g., a wing box). For example, the interior of the wing may be sealed using the example nozzles disclosed herein to form a fuel tank(s).

To control the flow rate of the substance out of the example nozzles disclosed herein, in some examples, the nozzles include a plug that is movable within the nozzle. In some examples, the plug includes an aperture(s) through which the substance can flow depending on the position of the plug within the nozzle. The plug may include any number of apertures (e.g., 1, 2, 7, etc.) and the apertures may be any shape that are similar or different from one another depending on the desired flow characteristics. For example, the plug may include oblong apertures circumferentially spaced about the plug. However, any aperture arrangement may be used.

In operation, in some examples, when the plug is in a retracted and/or in an upper location, the aperture(s) of the plug is covered by and/or sealingly engages an interior surface of the nozzle to prevent the substance from flowing out of the nozzle. In some examples, as the plug is extended and/or moved toward the opening of the nozzle, the plug moves away from being sealingly engaged by the interior surface of the nozzle uncovering the aperture(s) and enabling the substance to flow through the aperture(s). For example, to increase the flow out of the aperture(s), the plug can be moved from the interior surface sealingly engaging and/or covering 75% of the aperture(s) to the interior surface sealingly engaging and/or covering 50% of the aperture(s). In other words, the examples disclosed herein enable the flow of the substance to be controlled based on the relative positioning of the aperture and the interior surface of the nozzle while a pressure applied to the substance (e.g., sealant) at its source is kept substantially constant. As set forth herein, the phrase "substantially constant" accounts for pressure fluctuations and/or changes caused when operating a pressure source used in connection with the nozzles disclosed herein (e.g., between about +/−10 pounds per square inch (psi)).

In some examples, to change the flowrate out of the nozzle and/or to provide enhanced flow control, a gap defined between the plug and the interior surface of the nozzle is changeable to adjust a flow rate of the substance out of the nozzle. For example, as the plug moves toward seating against the interior surface of the nozzle, the gap between the plug and the nozzle decreases and as the plug retracts toward covering the aperture(s) of the plug, the gap between the plug and the nozzle increases. Additionally or alternatively, the example nozzles disclosed herein enable enhanced flow control by preventing/deterring the substance from flowing out of the nozzle in a lower position when the plug seats against the interior surface of the nozzle (e.g., needle valve operation) and in an upper position when the interior surface of the nozzle fully covers and sealingly engages against the aperture(s) of the plug (e.g., stuff-back valve operation).

In some examples, to draw the substance back within the nozzle and/or to deter the substance from inadvertently dripping out of the nozzle, the examples nozzles disclosed are configured and/or structured to perform a stuff-back operation. As disclosed herein, the phrase "stuff-back operation" refers to retracting the plug within the nozzle to draw the substance back within the nozzle and to increase space within the nozzle for the compressed substance to expand. Thus, after the stuff-back operation is performed, the substance can expand and/or decompress within the space of the nozzle based on the relative position of the plug. To enable a vacuum to be provided during the stuff-back operation to draw and/or pull the substance back within the nozzle, in some examples, an exterior surface of the plug and/or a sleeve/shaft/stem that moves the plug sealingly engages the interior surface of the nozzle.

In some examples, after the substance flows through the nozzle and/or after a sealing operation is performed, some parts of the nozzle may be replaced. For example, after the substance flows through the nozzle, the nozzle may be disassembled and the body of the nozzle, the sleeve and/or the plug may be removed and/or replaced. In some examples, the body of the nozzle, the sleeve and/or the plug are printed using a three-dimensional printer and/or any other manufacturing and/or production methods.

Figure 3:
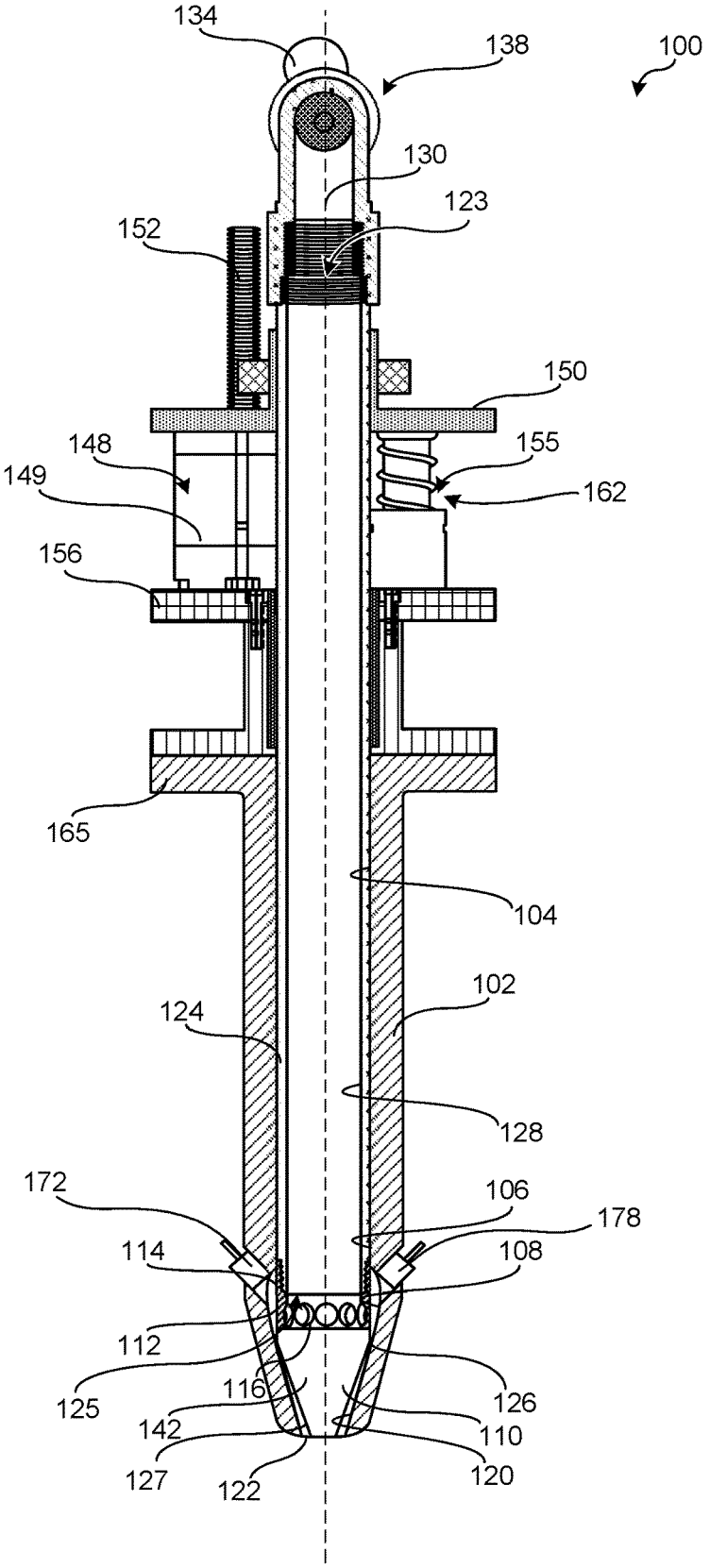

Referring generally to FIG. 1 and particularly to, e.g., FIG. 3, sealing surface 106 of channel 104 is cylindrical. Channel 104 further comprises internal tapered surface 120. Alcove surface 108 of channel 104 is outwardly recessed relative to internal tapered surface 120 of channel 104. Alcove surface 108 of channel 104 is between sealing surface 106 of channel 104 and internal tapered surface 120 of channel 104. The preceding subject matter of this paragraph characterizes example 2 of the present disclosure, wherein example 2 also includes the subject matter according to example 1, above.

Alcove surface 108 enables parameters of substance 101 to be monitored as nozzle 102 dispenses substance 101 on, for example, an interior section of an airplane wing, enabling a consistent and/or desired amount of substance 101 to be applied.

To enable parameters that affect the flow rate and/or viscosity of the substance to be determined, in some examples, the example nozzles include an area (e.g., a bulbous area, an alcove, etc.) where sensors may be disposed and/or where measurements of the environment within the nozzle and/or the substance may be obtained. Some parameters that may affect the viscosity and/or the flow rate of the substance include temperature, humidity and/or pressure. However, different and/or additional parameters may be measured and/or may affect the substance depending on the circumstances.

Referring generally to FIG. 1 and particularly to, e.g., FIGS. 3-6 and 8, outlet 122 of nozzle 102 is concentric with plug 110, located in channel 104 of nozzle 102. The preceding subject matter of this paragraph characterizes example 3 of the present disclosure, wherein example 3 also includes the subject matter according to example 2, above.

In some examples, having outlet 122 of nozzle 102 and plug 110 concentric reduces an amount of leakage and/or unwanted discharge of substance 101 by reducing a quantity of substance 101 contained within nozzle 102 between sealing surface 106 of channel 104 of nozzle 102 and outlet 122 of nozzle 102. Thus, when plug 110 moves to a retracted position to draw substance 101 back into nozzle 102 during a snuff-back operation, there is less quantity of substance 101 to draw back into nozzle 102.

Referring generally to FIG. 1 and particularly to, e.g., FIGS. 3-6 and 8, outlet 122 of nozzle 102, internal tapered surface 120 of channel 104, and sealing surface 106 of channel 104 are concentric with each other. The preceding subject matter of this paragraph characterizes example 4 of the present disclosure, wherein example 4 also includes the subject matter according to example 2 or example 3, above.

Having outlet 122 of nozzle 102 and plug 110 concentric reduces an amount of leakage and/or unwanted discharge of substance 101 by reducing a quantity of substance 101 contained within nozzle 102 between sealing surface 106 of channel 104 of nozzle 102 and outlet 122 of nozzle 102. Thus, when plug 110 moves to a retracted position to draw substance 101 back into nozzle 102 during a snuff-back operation, there is less quantity of substance 101 to draw back into nozzle 102.

Referring generally to FIG. 1 and particularly to, e.g., FIGS. 3-6 and 8, dispensing unit 100 further comprising sleeve 124, having first end 123 and second end 125, located opposite first end 123. Second end 125 of sleeve 124 is fixed to plug 110 and sleeve 124 is movable relative to nozzle 102. The preceding subject matter of this paragraph characterizes example 5 of the present disclosure, wherein example 5 also includes the subject matter according to example 2 or example 4, above.

Coupling of sleeve 124 and plug 110 enables first aperture 116 of plug 110 to be moved relative to sealing surface 106 of channel 104 of nozzle 102 to control a flow rate of substance 101 out of first aperture 116 of plug 110. Coupling of sleeve 124 and plug 110 also delivers substance 101 to plug 110 and to first aperture 116 of plug 110.

To enable the substance to be delivered to the plug and/or out of the nozzle and to enable the plug to be moved within the nozzle, in some examples, a sleeve, stem and/or shaft is coupled to the plug. To enable the plug to be easily decoupled and/or coupled to the sleeve, the coupling may be a threaded coupling. However, any other coupling may be used. To enable the sleeve to receive an input from an actuator or other source to move the sleeve, in some examples, the sleeve extends along a substantial length of and out of the channel.

Figure 4:
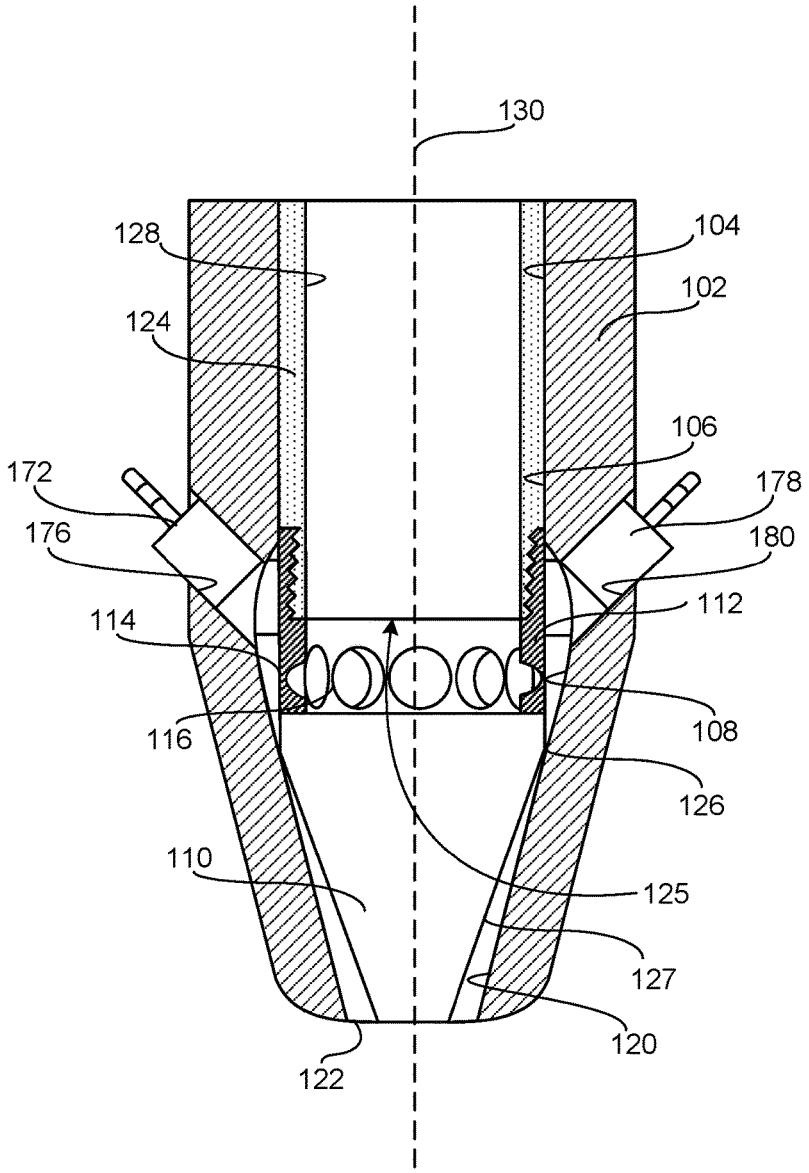
Figure 6:
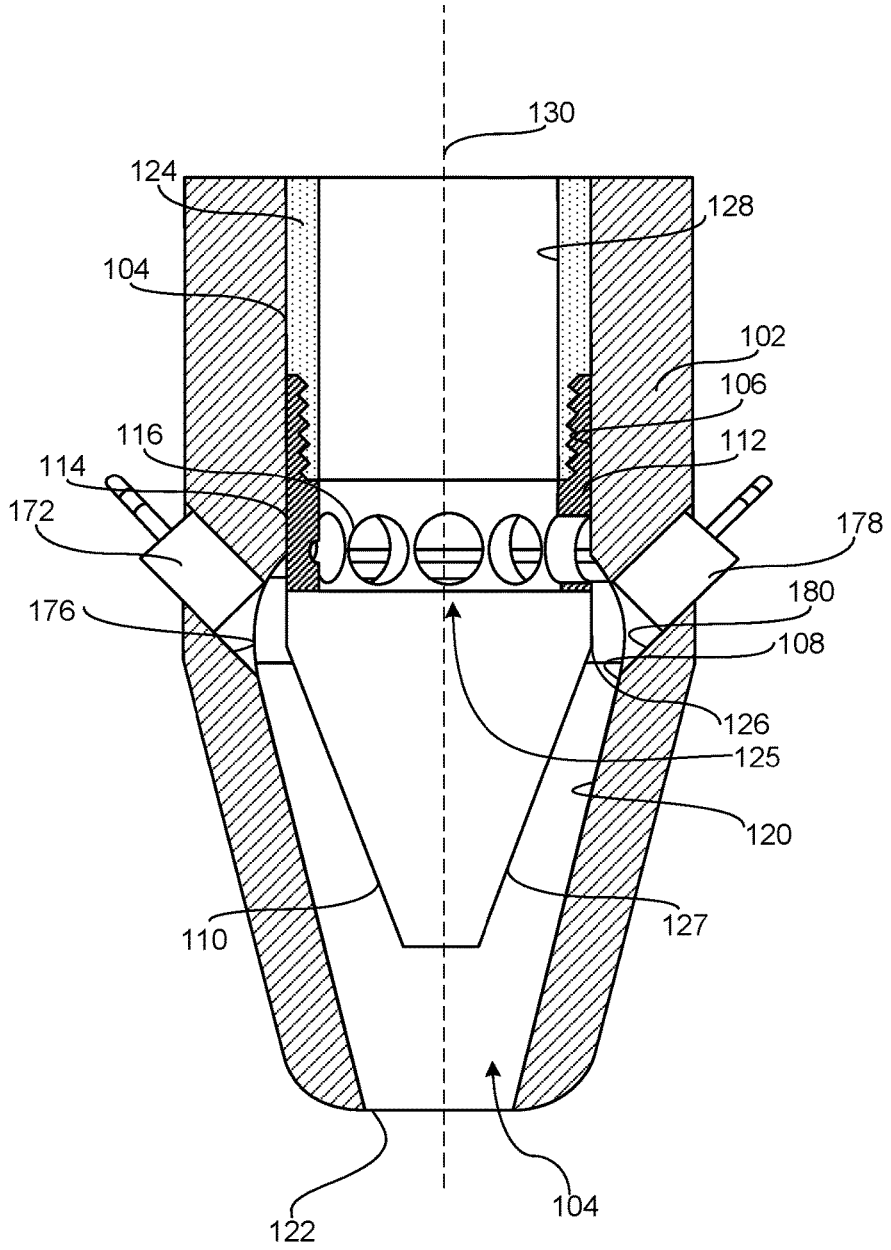
Figure 7:
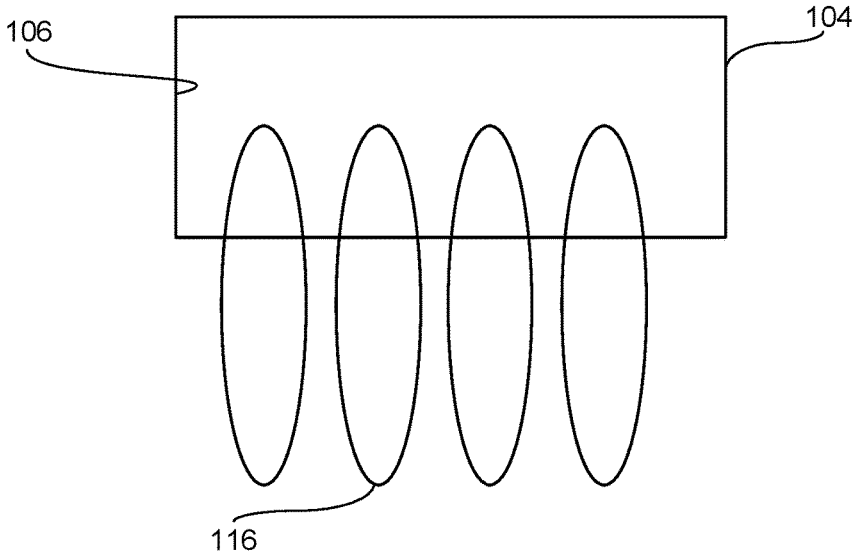
Figure 8:
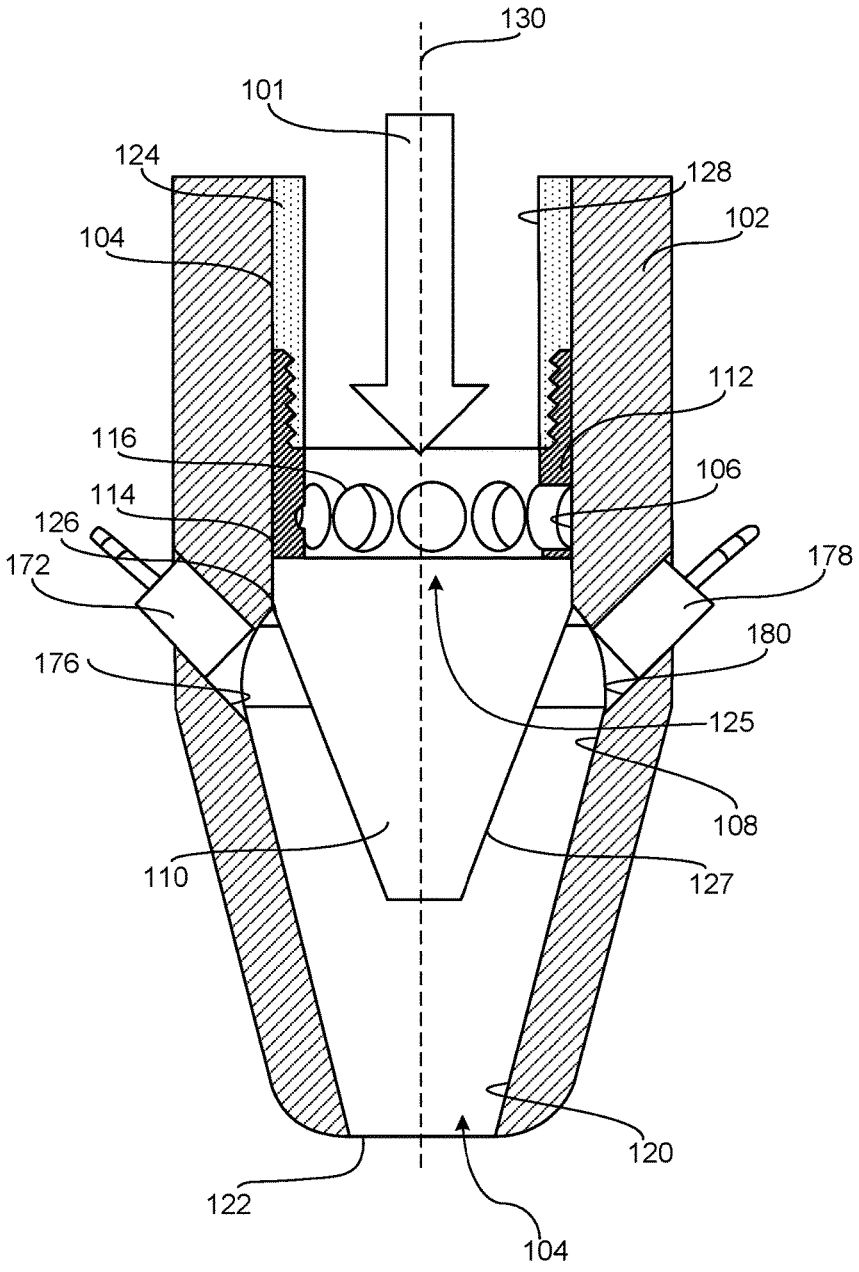

Referring generally to FIG. 1 and particularly to, e.g., FIGS. 4, 6, and 8, plug 110 is positionable by sleeve 124 along channel 104 such that sealing surface 106 of channel 104 prevents substance 101 from flowing through first aperture 116 of plug 110. Plug 110 is also positionable by sleeve 124 along channel 104 such that sealing surface 106 of channel 104 prevents substance 101 from flowing through a portion of first aperture 116 in wall 112 of plug 110. Plug 110 is additionally positionable by sleeve 124 along channel 104 such that sealing surface 106 of channel 104 does not prevent substance 101 from flowing through first aperture 116 in wall 112 of plug 110. The preceding subject matter of this paragraph characterizes example 6 of the present disclosure, wherein example 6 also includes the subject matter according to example 5, above.

Moving plug 110 to an upper location at which sealing surface 106 of channel 104 of nozzle 102 fully covers first aperture 116 of plug 110 prevents the flow of substance 101 through first aperture 116 of plug 110. Moving plug 110 to a location at which sealing surface 106 of channel 104 of nozzle 102 partially covers and/or does not cover first aperture 116 of plug 110 enables the flow of substance 101 through a portion of first aperture 116 of plug 110.

Referring generally to FIG. 1 and particularly to, e.g., FIGS. 3-6 and 8, plug 110 further comprises shoulder 126. When plug 110 is positioned along channel 104 such that sealing surface 106 of channel 104 does not prevent substance 101 from flowing through first aperture 116 in wall 112 of plug 110 and shoulder 126 of plug 110 is seated against internal tapered surface 120 of channel 104, substance 101 is prevented from flowing through outlet 122 of nozzle 102. The preceding subject matter of this paragraph characterizes example 7 of the present disclosure, wherein example 7 also includes the subject matter according to example 6, above.

Moving plug 110 to a lower-most location at which plug 110 engages internal tapered surface 120 of channel 104 of nozzle 102 enables the flow of substance 101 out of first aperture 116 of plug 110, but prevents the flow of substance 101 out of outlet 122 of nozzle 102.

Referring generally to FIG. 1 and particularly to, e.g., FIGS. 3-6 and 8, plug 110 further comprises external tapered surface 127. Shoulder 126 of plug 110 is between external tapered surface 127 of plug 110 and outer surface 114 of wall 112 of plug 110. The preceding subject matter of this paragraph characterizes example 8 of the present disclosure, wherein example 8 also includes the subject matter according to example 7, above.

Plug 110 includes external tapered surface 127 to enable plug 110 to seat against internal tapered surface 120 of channel 104 of nozzle 102. Additionally or alternatively, plug 110 includes external tapered surface 127 to enable the flowrate of substance 101 to be varied based on a relative position between external tapered surface 127 and internal tapered surface 120 of channel 104 of nozzle 102.

Referring generally to FIG. 1 and particularly to, e.g., FIGS. 3-6 and 8, external tapered surface 127 of plug 110 and internal tapered surface 120 of channel 104 of nozzle 102 have different tapers. The preceding subject matter of this paragraph characterizes example 9 of the present disclosure, wherein example 9 also includes the subject matter according to example 8, above.

Plug 110 includes external tapered surface 127 that has a different taper than internal tapered surface 120 of channel 104 of nozzle 102 to enable shoulder 126 of plug 110 to engage internal tapered surface 120 of channel 104 of nozzle 102. Additionally or alternatively, plug 110 includes external tapered surface 127 that has a different taper than internal tapered surface 120 of channel 104 of nozzle 102 to enable substance 101 to flow between external tapered surface 127 of plug 110 and internal tapered surface 120 of channel 104 of nozzle 102 based on a position of plug 110 within channel 104 of nozzle 102.

Referring generally to FIG. 1 and particularly to, e.g., FIGS. 3-6 and 8, sleeve 124 comprises bore 128 in communication with first aperture 116 of plug 110. The preceding subject matter of this paragraph characterizes example 10 of the present disclosure, wherein example 10 also includes the subject matter according to any one of examples 5 to 9, above.

Communicatively/fluidly coupling bore 128 and first aperture 116 of plug 110 enables substance 101 to be delivered to and out of first aperture 116 of plug 110.

Referring generally to FIG. 1 and particularly to, e.g., FIGS. 3-6 and 8, sleeve 124 is coaxial with longitudinal symmetry axis 130 of nozzle 102. The preceding subject matter of this paragraph characterizes example 11 of the present disclosure, wherein example 11 also includes the subject matter according to any one of examples 5 to 10, above.

Sleeve 124 being coaxial with longitudinal symmetry axis 130 of nozzle 102 enables sleeve 124 to move plug 110 within channel 104 of nozzle 102.

Figure 2:
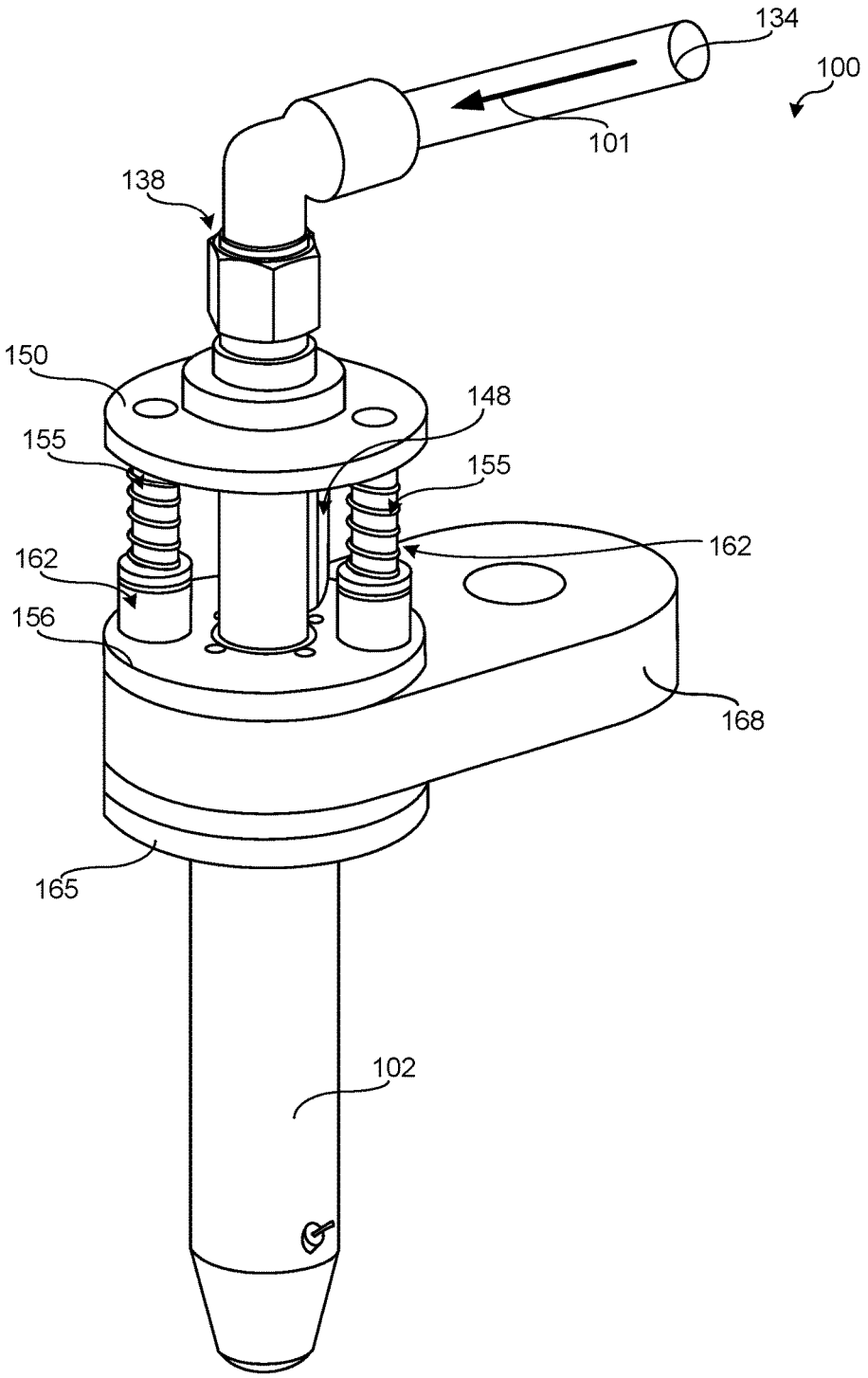

Referring generally to FIG. 1 and particularly to, e.g., FIGS. 2 and 3, dispensing unit 100 also comprises input line 134, coupled to first end 123 of sleeve 124 to deliver substance 101 into sleeve 124. The preceding subject matter of this paragraph characterizes example 12 of the present disclosure, wherein example 12 also includes the subject matter according to any one of examples 5 to 11, above.

Input line 134 enables substance 101 to be delivered to nozzle 102. In some examples, input line 134 is communicatively/fluidly coupled to first aperture 116 of plug 110 to enable substance 101 to be delivered to and through first aperture 116 of plug 110. Input line 134 can be a fluid delivery line, a flowline, an input flow path, etc. to deliver substance 101 to nozzle 102.

In some examples, to enable the substance to be dispensed from the nozzle, the sleeve is coupled to an input line (e.g., a flowline). To enable the sleeve to be easily coupled and/or decoupled from the input line, the coupling between the sleeve and the input line may be a threaded coupling. However, any other coupling may be used. In some examples, the input line is directly coupled to the sleeve. In other examples, the input line is indirectly coupled to the sleeve where another coupling such as, for example, a rotatable coupling, is disposed between the sleeve and the input line. In either example, the coupling between the sleeve and the input line enables the substance to be delivered to the plug and/or out of the nozzle.

Referring to FIG. 1, dispensing unit 100 further comprises source 136 of substance 101. Input line 134 is coupled to source 136 of substance 101. The preceding subject matter of this paragraph characterizes example 13 of the present disclosure, wherein example 13 also includes the subject matter according to example 12, above.

The coupling between source 136 and input line 134 enables substance 101 to be delivered to nozzle 102. Source 136 may be any container to house and/or contain substance 101.

In some examples, a cartridge and/or tube (e.g., a 12-ounce cartridge) houses the substance being fed to the nozzle. The cartridge may be coupled to the nozzle, a robot holding the nozzle and/or another location while the substance is being applied to, for example, surfaces of an aircraft.

Referring generally to FIG. 1 and particularly to, e.g., FIGS. 2 and 3, dispensing unit 100 further comprises rotatable coupling 138 between input line 134 and first end 123 of sleeve 124. The preceding subject matter of this paragraph characterizes example 14 of the present disclosure, wherein example 14 also includes the subject matter according to example 12 or example 13, above.

Rotatable coupling 138 between input line 134 and sleeve 124 enables dispensing unit 100 to be moved to different positions when applying substance 101 to an intended surface and/or location.

Referring generally to FIG. 1 and particularly to, e.g., FIGS. 3-6 and 8, plug 110 is symmetric about longitudinal symmetry axis 130 of nozzle 102. The preceding subject matter of this paragraph characterizes example 15 of the present disclosure, wherein example 15 also includes the subject matter according to any one of examples 1 to 14, above.

Symmetry of plug 110 enables plug 110 to be self-centering when plug 110 engages internal tapered surface 120 of channel (104) of nozzle 102.

Referring generally to FIG. 1 and particularly to, e.g., FIGS. 2 and 3, dispensing unit 100 further comprises sleeve 124, first flange 150, second flange 156, spaced from first flange 150, and actuator 148. Sleeve 124 is fixed to plug 110. First flange 150 is fixed to sleeve 124. Actuator 148 comprises body 149 and leadscrew 152, extending from body 149 and threadably engaging first flange 150. Body 149 of actuator 148 is fixed to second flange 156. The preceding subject matter of this paragraph characterizes example 16 of the present disclosure, wherein example 16 also includes the subject matter according to any one of examples 1 to 4, above.

Actuator 148 enables plug 110 to be moved, via sleeve 124, to an upper location (e.g., a snuff-back location) at which sealing surface 106 of channel 104 of nozzle 102 fully covers first aperture 116 of plug 110 and prevents the flow of substance 101 out of first aperture 116 of plug 110. Additionally, actuator 148 enables plug 110 to be moved, via sleeve 124, to a location at which sealing surface 106 of channel 104 of nozzle 102 partially covers first aperture 116 of plug 110 and enables the flow of substance 101 through a portion of first aperture 116 of plug 110.

To enable the plug to be moved within the nozzle to control the flow of the substance out of the nozzle, in some examples, an actuator is coupled to the plug. The actuator can be coupled to the plug in different ways. For example, the actuator can be coupled to the plug via a sleeve that delivers a substance to the plug.

In some examples, to couple the actuator and the plug, the nozzle includes opposing flanges where a body of the actuator is coupled to one of the flanges and a shaft and/or leadscrew (e.g., a ball screw) of the actuator is coupled to the other of the flanges. In such examples, as the actuator drives the shaft and/or the leadscrew, the flanges are moved relative to one another to change a position of the plug within the nozzle. In some examples, a single actuator is used to move the plug. In other examples, more than one actuator is used to move the plug.

Referring generally to FIG. 1 and particularly to, e.g., FIGS. 2 and 3, dispensing unit 100 further comprises means 155 for biasing first flange 150 away from second flange 156. The preceding subject matter of this paragraph characterizes example 17 of the present disclosure, wherein example 17 also includes the subject matter according to example 16, above.

Means 155 for biasing first flange 150 away from second flange 156 enables plug 110 to be quickly retracted to an upper position within channel 104 of nozzle 102 to perform a snuff-back procedure.

To enable the plug to be quickly retracted during a snuff-back operation and/or to deter components (e.g., the sleeve, the plug, etc.) of the nozzle from becoming jammed as the plug moves within the nozzle, in some examples, means for biasing the first flange away from the second flange 156 is a spring or springs, disposed between opposing flanges of the nozzle where one of the flanges is coupled to the sleeve and the other of the flanges is coupled to a body of the nozzle. In other words, springs may be used to urge components of the nozzle away from one another and/or to reduce play between the components of the nozzle. Any number of springs may be used that are positioned in any location(s) (e.g., opposite sides of the nozzle). In some examples, to increase the slidability of the sleeve within the nozzle, the nozzle includes an oil-embedded sleeve through which a shaft and/or sleeve of the plug extends. In some examples, the oil-embedded sleeve extends along an aperture defined by a two-part spindle of the nozzle. In some examples, the spindle and a body of the nozzle are couplable via a twist-lock interface to enable the body to be easily coupled and/or decoupled from the spindle. However, in other examples, any other coupling and/or fastener may be used.

Referring generally to FIG. 1 and particularly to, e.g., FIGS. 2 and 3, dispensing unit 100 further comprises guide 162 to align means 155 for biasing first flange 150 away from second flange 156 with respect to longitudinal symmetry axis 130. The preceding subject matter of this paragraph characterizes example 18 of the present disclosure, wherein example 18 also includes the subject matter according to example 17, above.

Guide 162 deters means 155 for biasing first flange 150 away from second flange 156 from jamming when means 155 for biasing first flange 150 away from second flange 156 biases plug 110 away from outlet 122 of nozzle 102.

To deter any components (e.g., the sleeve, the plug, etc.) from becoming jammed as the plug moves within the nozzle, in some examples, the nozzle includes a linear bearing and a rod where the linear bearing is coupled to one of the flanges of the nozzle and the rod is coupled (e.g., press fit) to another one of the flanges of the nozzle to enable the rod to pass through the linear bearing. In some examples, a spring is positioned around the rod to encourage smooth movement of the components of the nozzle as the plug is moved and/or to reduce play between the components of the nozzle.

In operation, in some examples, the interaction between the linear bearing and the rod encourages the plug to move along and/or substantially along a longitudinal axis of the channel. As set forth herein, the phrase "moving the plug substantially along the longitudinal axis of the channel" means that movement of the plug is between about 0 and 5 degrees from following the longitudinal axis of the channel and/or accounts for manufacturing tolerances. In some examples, a single linear bearing/rod pair is used to guide the movement of the components of the nozzle. In other examples, multiple linear bearing/rod pairs (e.g., 2, 3, etc.) are used to guide the movement of the components of the nozzle.

Referring generally to FIG. 1 and particularly to, e.g., FIGS. 2 and 3, nozzle 102 comprises third flange 165, located opposite outlet 122 of nozzle 102. Third flange 165 is fixed to second flange 156. The preceding subject matter of this paragraph characterizes example 19 of the present disclosure, wherein example 19 also includes the subject matter according to example 18, above.

Third flange 165 provides a surface to enable nozzle 102 to be fixed/coupled to second flange 156.

Referring generally to FIG. 1 and particularly to, e.g., FIG. 2, dispensing unit 100 further comprises support bracket 168, coupled to second flange 156. The preceding subject matter of this paragraph characterizes example 20 of the present disclosure, wherein example 20 also includes the subject matter according to example 18 or example 19, above.

Bracket 168 enables dispensing unit 100 to be coupled to a robot that controls a position of dispensing unit 100 when dispensing unit 100 dispenses substance 101 on, for example, an interior section of an airplane wing.

In examples when the nozzles and/or end-effectors are used with robotic systems, the nozzle and/or end-effector may be coupled to the robot (e.g., a robotic arm, etc.) via a bracket. In some examples, the bracket is disposed within a groove defined by opposing flanges of the nozzle that form a spindle (e.g., a two-piece spindle). In such examples, to couple the bracket to the nozzle, an aperture of the bracket is positioned around a collar of one of the flanges and the other one of the flanges is positioned overtop top of the bracket and coupled to the collar to form the two-piece spindle and to retain the bracket within the groove. In some examples, the coupling between the bracket and the nozzle enables rotational movement of the nozzle relative to the bracket while substantially fixing the bracket relative to the longitudinal axis of the nozzle. In other examples, a splined interface and/or other coupling between the bracket and the spindle deters rotational movement of nozzle relative to the bracket.

Referring generally to FIG. 1 and particularly to, e.g., FIGS. 2-6 and 8, dispensing unit 100 further comprises temperature sensor 172. Nozzle 102 further comprises second aperture 176 that penetrates alcove surface 108. Temperature sensor 172 is received within second aperture 176. The preceding subject matter of this paragraph characterizes example 21 of the present disclosure, wherein example 21 also includes the subject matter according to any one of examples 1 to 12, above.

Forming second aperture 176 in nozzle 102 enables nozzle 102 to house and/or retain a position of temperature sensor 172 relative to alcove surface 108 to monitor characteristics of substance 101.

Referring to FIG. 1, dispensing unit 100 also comprises pressure source 182 and controller 174. Controller 174 is operatively coupled to pressure source 182 and to temperature sensor 172 to control, based on signals, obtained from temperature sensor 172, a flow rate of substance 101 through outlet 122 of nozzle 102. The preceding subject matter of this paragraph characterizes example 22 of the present disclosure, wherein example 22 also includes the subject matter according to example 21, above.

Controller 174 is operatively coupled to temperature sensor 172 to obtain/process a temperature value(s) of substance 101 and to adjust a position of plug 110 relative to outlet 122 of nozzle 102 based on the processing to control a flow rate of substance 101 through outlet 122 of nozzle 102.

In some examples, to control the flow of the substance out of the nozzle, sensors monitor parameters that affect the viscosity of the substance. Based on the parameters measured, in some examples, a controller processes the parameters and/or causes an actuator to adjust a position of the plug within the nozzle. In other words, the example nozzles disclosed herein are responsive to environmental and/or other factors affecting the substance to enable a desired flow of the substance to be achieved and/or to adjust the parameters within the nozzle. For example, adjusting the position of the plug within the nozzle may change a pressure sensed at an outlet of the nozzle.

Referring generally to FIG. 1, dispensing unit 100 further comprises pressure sensor 178. Nozzle 102 comprises third aperture 180 that penetrates alcove surface 108 Pressure sensor 178 is received within third aperture 180. Controller 174 is operatively coupled to pressure source 182 and pressure sensor 178 to control, based on signals, obtained from pressure sensor 178, flow rate of substance 101 through outlet 122 of nozzle 102. The preceding subject matter of this paragraph characterizes example 23 of the present disclosure, wherein example 23 also includes the subject matter according to example 22, above.

Forming third aperture 180 in nozzle 102 enables nozzle 102 to house and/or retain a position of pressure sensor 178 relative to alcove surface 108 to monitor characteristic(s) of substance 101. Controller 174 is operatively coupled to pressure sensor 178 to process a pressure value(s) of substance 101 and/or to adjust a position of plug 110 relative to outlet 122 of nozzle 102 based on the processing to control a flow rate of substance 101 through outlet 122 of nozzle 102.

Referring to FIG. 1, dispensing unit 100 further comprises source 136 of substance 101. Pressure source 182 is operatively coupled with source 136 of substance 101. Controller 174 is to adjust pressure in nozzle 102 based on signals obtained from at least one of temperature sensor 172 or pressure sensor 178. The preceding subject matter of this paragraph characterizes example 24 of the present disclosure, wherein example 24 also includes the subject matter according to example 23, above.

Controller 174 varies pressure within nozzle 102 to control flowrate of substance 101 exiting nozzle 102.

Referring generally to FIG. 1 and particularly to, e.g., FIGS. 2 and 3, dispensing unit 100 further comprises actuator 148. Controller 174 is operatively coupled with actuator 148 to adjustably position plug 110 relative to nozzle 102 based on signals obtained from at least one of temperature sensor 172 or pressure sensor 178. The preceding subject matter of this paragraph characterizes example 25 of the present disclosure, wherein example 25 also includes the subject matter according to example 24, above.

Controlling a position of plug 110 based on the pressure determined by pressure sensor 178 and/or the temperature determined by temperature sensor 172 enables a desired flow of substance 101 to be achieved.

Referring generally to FIG. 1 and particularly to, e.g., FIGS. 2 and 3, dispensing unit 100 further comprises source 136 of substance 101. Controller 174 is to adjust a position of plug 110 based on signals obtained from at least one of temperature sensor 172 or pressure sensor 178; and pressure source 182 is to deliver substance 101 from source 136 to nozzle 102 at a constant pressure. The preceding subject matter of this paragraph characterizes example 26 of the present disclosure, wherein example 26 also includes the subject matter according to example 23, above.

Applying a relatively constant pressure on substance 101 reduces a number of changing variables present when dispensing substance 101 from nozzle 102 and enables a constant and/or desired thickness and/or pattern of substance 101 to be achieved.

Figure 9:
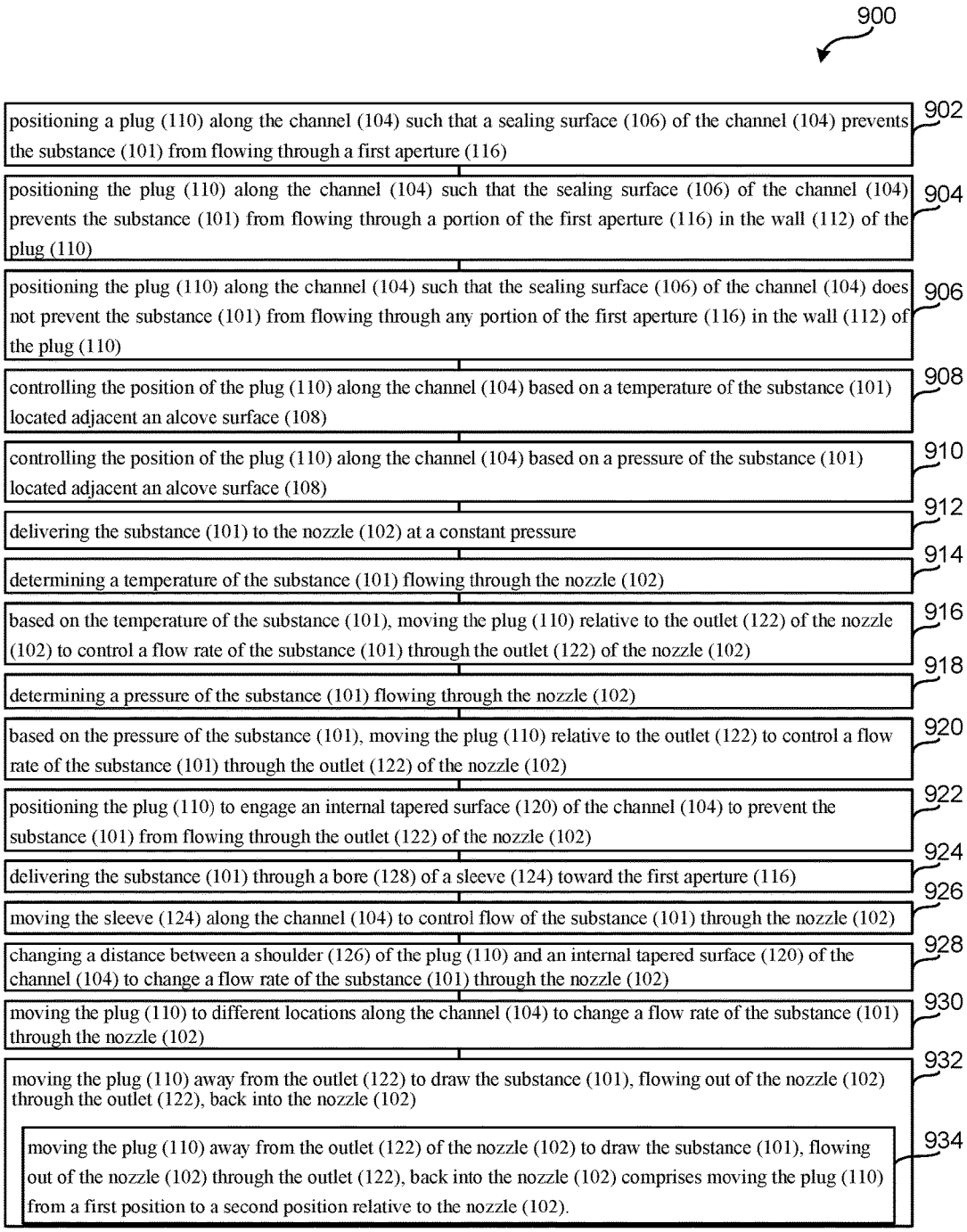

Referring generally to, e.g., 1-8 and particularly to FIG. 9, method 900 of controlling flow of substance 101 through nozzle 102, having channel 104 terminating in outlet 122, is disclosed. Method 900 comprising at least one of: (block 902) positioning plug 110, comprising wall 112, along channel 104 such that sealing surface 106 of channel 104 prevents substance 101 from flowing through first aperture 116 that penetrates wall 112 of plug 110 through outer surface 114 of wall 112, wherein outer surface 114 of wall 112 of plug 110 is complementary with sealing surface 106 of channel 104 of nozzle 102; (block 904) positioning plug 110 along channel 104 such that sealing surface 106 of channel 104 prevents substance 101 from flowing through a portion of first aperture 116 in wall 112 of plug 110; and (block 906) positioning plug 110 along channel 104 such that sealing surface 106 of channel 104 does not prevent substance 101 from flowing through any portion of first aperture 116 in wall 112 of plug 110. The preceding subject matter of this paragraph characterizes example 27 of the present disclosure.

Moving plug 110 to an upper location (e.g., a snuff-back location) at which sealing surface 106 of channel 104 of nozzle 102 fully covers first aperture 116 of plug 110 prevents a flow of substance 101 through first aperture 116 of plug 110. Moving plug 110 to a location at which sealing surface 106 of channel 104 of nozzle 102 partially covers first aperture 116 of plug 110 enables a flow of substance 101 through a portion of first aperture 116 of plug 110. Moving plug 110 to a location spaced from sealing surface 106 of channel 104 of nozzle 102 enables a flow of substance 101 through first aperture 116 of plug 110.

Referring generally to, e.g., 1-8 and particularly to FIG. 9, method 900 further comprises (block 908) controlling the position of plug 110 along channel 104 based on a temperature of substance 101 located adjacent alcove surface 108, contiguous with sealing surface 106 of channel 104 and outwardly recessed relative to sealing surface 106. The preceding subject matter of this paragraph characterizes example 28 of the present disclosure, wherein example 28 also includes the subject matter according to example 27, above.

Controller 174 is operatively coupled to temperature sensor 172 to obtain/process a temperature value(s) of substance 101 and to adjust a position of plug 110 relative to outlet 122 of nozzle 102 based on the processing to control a flow rate of substance 101 through outlet 122 of nozzle 102.

Referring generally to, e.g., 1-8 and particularly to FIG. 9, method 900 further comprises (block 910) controlling the position of plug 110 along channel 104 based on a pressure of substance 101 located adjacent alcove surface 108, contiguous with sealing surface 106 of channel 104 and outwardly recessed relative to sealing surface 106. The preceding subject matter of this paragraph characterizes example 29 of the present disclosure, wherein example 29 also includes the subject matter according to example 27 or example 28, above.

Controller 174 is operatively coupled to pressure sensor 178 to process a pressure value(s) of substance 101 and to adjust a position of plug 110 relative to outlet 122 of nozzle 102 based on the processing to control a flow rate of substance 101 through outlet 122 of nozzle 102.

Referring generally to, e.g., 1-8 and particularly to FIG. 9, method 900 further comprises (block 912) delivering substance 101 to nozzle 102 at a constant pressure. The preceding subject matter of this paragraph characterizes example 30 of the present disclosure, wherein example 30 also includes the subject matter according to example 27, above.

Applying a relatively constant pressure on substance 101 reduces a number of changing variables present when dispensing substance 101 from nozzle 102 and/or enables a constant and/or desired thickness and/or pattern of substance 101 to be achieved.

Referring generally to, e.g., 1-8 and particularly to FIG. 9, method 900 further comprises (block 914) determining a temperature of substance 101, flowing through nozzle 102. Method 900 also comprises, (block 916) based on the temperature of substance 101, moving plug 110 relative to outlet 122 of nozzle 102 to control a flow rate of substance 101 through outlet 122 of nozzle 102. The preceding subject matter of this paragraph characterizes example 31 of the present disclosure, wherein example 31 also includes the subject matter according to example 27, above.

Monitoring parameter(s) of substance (101) as nozzle 102 dispenses substance 101 on, for example, an interior section of an airplane wing, enables a consistent and/or desired amount of substance 101 to be applied.

Referring to method 900 of FIG. 9 with reference to FIGS. 1-8, method 900 further comprises (block 918) determining a pressure of substance 101 flowing through nozzle 102. Method 900 also comprises, (block 920) based on the pressure of substance 101, moving plug 110 relative to outlet 122 of nozzle 102 to control a flow rate of substance 101 through outlet 122 of nozzle 102. The preceding subject matter of this paragraph characterizes example 32 of the present disclosure, wherein example 32 also includes the subject matter according to example 27 or example 31, above.

Monitoring parameter(s) of substance 101 as nozzle 102 dispenses substance 101 on, for example, an interior section of an airplane wing, enables a consistent and/or desired amount of substance 101 to be applied.

Referring generally to, e.g., 1-8 and particularly to FIG. 9, method 900 further comprises (block 922) positioning plug 110 to engage internal tapered surface 120 of channel 104 of nozzle 102 to prevent substance 101 from flowing through outlet 122 of nozzle 102. The preceding subject matter of this paragraph characterizes example 33 of the present disclosure, wherein example 33 also includes the subject matter according to any one of examples 27 to 32, above.

Moving plug 110 to a lower most location at which plug 110 engages internal tapered surface 120 of channel 104 of nozzle 102 enables a flow of substance 101 out of first aperture 116 of plug 110 but prevents the flow of substance 101 out of outlet 122 of nozzle 102.

Referring generally to, e.g., 1-8 and particularly to FIG. 9, method 900 further comprises (block 924) delivering substance 101 through bore 128 of sleeve 124 toward first aperture 116 of plug 110. Sleeve 124 is fixed to plug 110. The preceding subject matter of this paragraph characterizes example 34 of the present disclosure, wherein example 34 also includes the subject matter according to any one of examples 27 to 33, above.

Communicatively/fluidly coupling bore 128 and first aperture 116 of plug 110 enables substance 101 to be delivered to and out of first aperture 116 of plug 110.

Referring generally to, e.g., 1-8 and particularly to FIG. 9, method 900 further comprises (block 926) moving sleeve 124 along channel 104 of nozzle 102 to control flow of substance 101 through nozzle 102. The preceding subject matter of this paragraph characterizes example 35 of the present disclosure, wherein example 35 also includes the subject matter according to example 34, above.

Moving sleeve 124 and plug 110 controls a flow rate of substance 101 out of nozzle 102.

Referring generally to, e.g., 1-8 and particularly to FIG. 9, method 900 further comprises (block 928) changing a distance between shoulder 126 of plug 110 and internal tapered surface 120 of channel 104 of nozzle 102 to change a flow rate of substance 101 through nozzle 102. The preceding subject matter of this paragraph characterizes example 36 of the present disclosure, wherein example 36 also includes the subject matter according to example 27, above.

Figure 5:
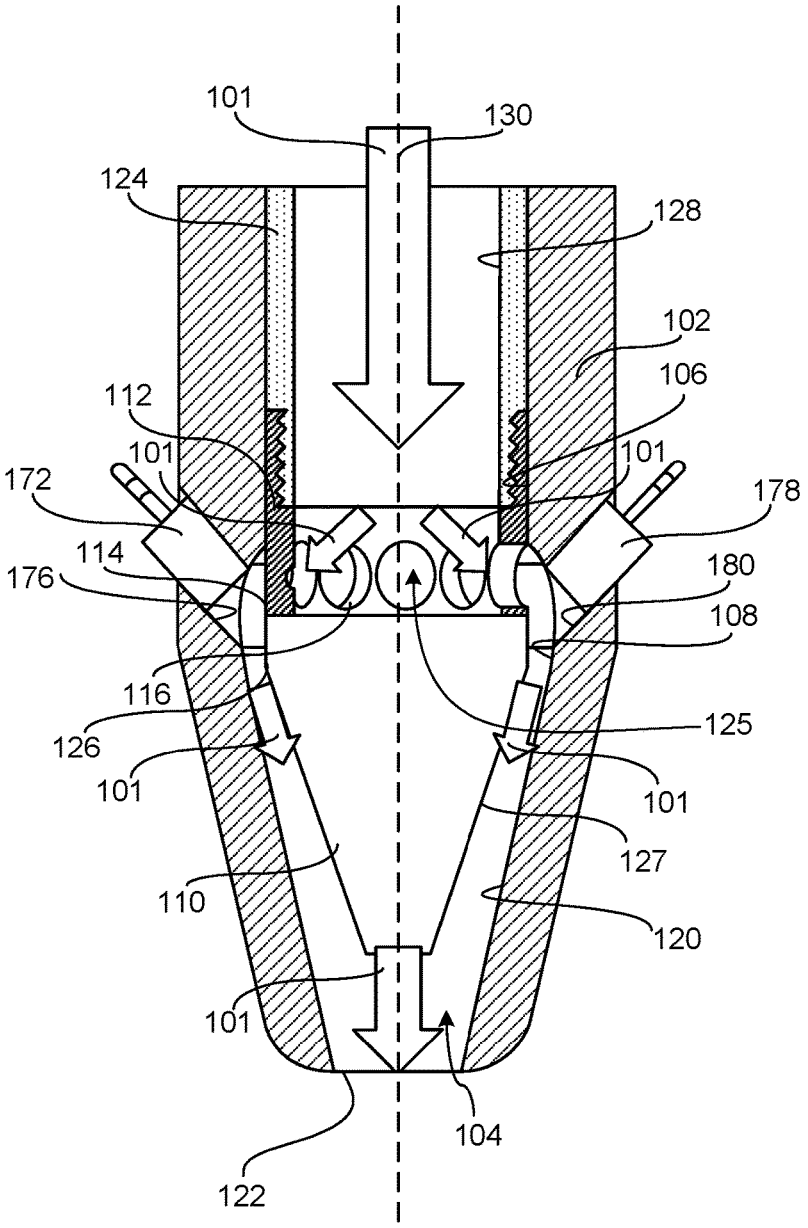

As shown in the example of FIG. 5, relative positioning of plug 110 and internal tapered surface 120 of channel 104 of nozzle 102 changes a space and/or gap through which substance 101 can flow out of nozzle 102. In other words, in the illustrated example of FIG. 5, a tapered cross-section of plug 110 enables enhanced control of substance 101 through nozzle 102 based on a positioning of plug 110 within nozzle 102.

Referring generally to, e.g., 1-8 and particularly to FIG. 9, method 900 further comprises (block 930) moving plug 110 to different locations along channel 104 of nozzle 102 to change a flow rate of substance 101 through nozzle 102. The preceding subject matter of this paragraph characterizes example 37 of the present disclosure, wherein example 37 also includes the subject matter according to any one of examples 27 to 36, above.

As shown in the example of FIG. 6, a relative positioning of plug 110 and sealing surface 106 of channel 104 of nozzle 102 changes an amount that sealing surface 106 of channel 104 of nozzle 102 covers first aperture 116 of plug 110 and a flow rate of substance 101 through first aperture 116 of plug 110.

Referring generally to, e.g., 1-8 and particularly to FIG. 9, method 900 further comprises (block 932) moving plug 110 away from outlet 122 of nozzle 102 to draw substance 101, flowing out of nozzle 102 through outlet 122, back into nozzle 102. The preceding subject matter of this paragraph characterizes example 38 of the present disclosure, wherein example 38 also includes the subject matter according to any one of examples 27 to 37, above.

To avoid uncontrolled dripping of substance 101 from outlet 122 of nozzle 102, nozzle 102 performs a snuff-back operation that draws substance 101 back into nozzle 102.

Referring generally to, e.g., 1-8 and particularly to FIG. 9, according to method 900, (block 934) moving plug 110 away from outlet 122 of nozzle 102 to draw substance 101, flowing out of nozzle 102 through outlet 122, back into nozzle 102 comprises moving plug 110 from a first position to a second position relative to nozzle 102. The preceding subject matter of this paragraph characterizes example 39 of the present disclosure, wherein example 39 also includes the subject matter according to example 38, above.

To avoid uncontrolled dripping of substance 101 from outlet 122 of nozzle 102 when moving nozzle 102 between different positions, nozzle 102 performs a snuff-back operation that draws substance 101 back into nozzle 102.

Examples of the present disclosure may be described in the context of aircraft manufacturing and service method 1100 as shown in FIG. 10 and aircraft 1102 as shown in FIG. 11. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 11, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A dispensing unit for controlling flow of a substance, the dispensing unit comprising:
- an inlet to receive the substance;
- a nozzle that is in fluidic communication with the inlet and that comprises:
  - an outlet; and
  - a channel, comprising:
    - a longitudinal symmetry axis;
    - a sealing surface that is cylindrical;
    - an internal tapered surface; and
    - an alcove surface that is contiguous with the sealing surface, outwardly recessed relative to the internal tapered surface of the channel, and located between the sealing surface of the channel and the internal tapered surface of the channel;
- a plug, comprising:
  - a wall that comprises an outer surface; and
  - a first aperture, fully penetrating the wall through the outer surface of the wall of the plug; and wherein:
    - the outer surface of the wall, comprising the first aperture, and
  - the plug is movable in the channel; and
- a sleeve, having a first end and a second end, located opposite the first end, and wherein:
- the second end of the sleeve is fixed to the plug,
- the sleeve is movable relative to the nozzle,
- when the plug is positioned by the sleeve such that the first aperture in its entirety faces the sealing surface of the channel, the substance is unable to flow through the first aperture of the plug, and
- when the plug is positioned by the sleeve such that at least a portion of the first aperture of the plug faces toward the alcove surface, the substance is able to flow through the first aperture of the plug.

2. The dispensing unit according to claim 1, wherein:
- the plug is positionable by the sleeve along the channel such that the sealing surface of the channel prevents the substance from flowing through a portion of the first aperture in the wall of the plug.

3. The dispensing unit according to claim 2, wherein:
- the plug further comprises a shoulder; and
- when the plug is positioned along the channel such that the sealing surface of the channel does not prevent the substance from flowing through the first aperture in the wall of the plug and the shoulder of the plug is seated against the internal tapered surface of the channel, the substance is prevented from flowing through the outlet of the nozzle.

4. The dispensing unit according to claim 3, wherein:
- the plug further comprises an external tapered surface; and
- the shoulder of the plug is between the external tapered surface of the plug and the outer surface of the wall of the plug.

5. The dispensing unit according to claim 4, wherein the external tapered surface of the plug and the internal tapered surface of the channel of the nozzle have different tapers.

6. The dispensing unit according to claim 1, further comprising an input line, coupled to the first end of the sleeve to deliver the substance into the sleeve.

7. The dispensing unit according to claim 6, further comprising a rotatable coupling between the input line and the first end of the sleeve.

8. The dispensing unit according to claim 6, further comprising a source of the substance and wherein the input line is coupled to the source of the substance.

9. The dispensing unit according to claim 1, wherein the outer surface of the plug, comprising the first aperture, is complementary with the sealing surface of the channel.

10. The dispensing unit according to claim 1, wherein the outlet of the nozzle is concentric with the plug.

11. The dispensing unit according to claim 1, wherein the outlet of the nozzle, the internal tapered surface of the channel, and the sealing surface of the channel are concentric with each other.

12. The dispensing unit according to claim 1, wherein the sleeve comprises a bore in communication with the first aperture of the plug.

13. The dispensing unit according to claim 1, wherein the plug is symmetric about the longitudinal symmetry axis of the nozzle.

14. The dispensing unit according to claim 1, wherein the sleeve is coaxial with the longitudinal symmetry axis of the nozzle.

15. A dispensing unit for controlling flow of a substance, the dispensing unit comprising:
- an inlet to receive the substance;
- a nozzle that is in fluidic communication with the inlet and that comprises:
  - an outlet; and
    - a channel, comprising:
      - a longitudinal symmetry axis;
      - a sealing surface; and
      - an alcove surface that is contiguous with the sealing surface, outwardly recessed relative to the sealing surface, and located between the inlet of the dispensing unit and the outlet of the nozzle;
- a plug, comprising:
  - a wall that comprises an outer surface; and
  - a first aperture, fully penetrating the wall through the outer surface of the wall of the plug; and wherein:
    - the outer surface of the wall comprises the first aperture, and
  - the plug is movable in the channel; and
- a sleeve, a first flange, a second flange, spaced from the first flange, and an actuator and wherein:
- the sleeve is fixed to the plug;
- the first flange is fixed to the sleeve;
- the actuator comprises a body and a leadscrew, extending from the body and threadably engaging the first flange; and
- the body of the actuator is fixed to the second flange.

16. The dispensing unit according to claim 15, further comprising means for biasing the first flange away from the second flange.

17. The dispensing unit according to claim 16, further comprising a guide to align the means for biasing the first flange away from the second flange with respect to the longitudinal symmetry axis.

18. The dispensing unit according to claim 17, wherein:
the nozzle comprises a third flange, located opposite the outlet of the nozzle; and
the third flange is fixed to the second flange.

19. The dispensing unit according to claim 17, further comprising a support bracket, coupled to the second flange.

20. A dispensing unit for controlling flow of a substance, the dispensing unit comprising:
an inlet to receive the substance;
a nozzle that is in fluidic communication with the inlet and that comprises:
an outlet; and
a channel, comprising:
a longitudinal symmetry axis;
a sealing surface; and
an alcove surface that is contiguous with the sealing surface, outwardly recessed relative to the sealing surface, and located between the inlet of the dispensing unit and the outlet of the nozzle;
a plug, comprising:
a wall that comprises an outer surface; and
a first aperture, fully penetrating the wall through the outer surface of the wall of the plug; and wherein:
the outer surface of the wall comprises the first aperture, and
the plug is movable in the channel; and
a temperature sensor, and wherein:
the nozzle further comprises a second aperture that penetrates the alcove surface, and
the temperature sensor is received within the second aperture.

21. The dispensing unit according to claim 20, further comprising:
a pressure source; and
a controller, operatively coupled to the pressure source and to the temperature sensor to control, based on first signals, obtained from the temperature sensor, a flow rate of the substance through the outlet of the nozzle.

22. The dispensing unit according to claim 21, further comprising a pressure sensor and wherein:
the nozzle comprises a third aperture that penetrates the alcove surface;
the pressure sensor is received within the third aperture; and
the controller is operatively coupled to the pressure source and the pressure sensor to control, based on second signals, obtained from the pressure sensor, the flow rate of the substance through the outlet of the nozzle.

23. The dispensing unit according to claim 22, further comprising a source of the substance and wherein:
the pressure source is operatively coupled with the source of the substance; and
the controller is to adjust pressure in the nozzle based on the first signals, obtained from the temperature sensor, or the second signals, obtained from the pressure sensor, or the first signals and the second signals.

24. The dispensing unit according to claim 23, further comprising an actuator and wherein the controller is operatively coupled with the actuator to adjustably position the plug relative to the nozzle based on the first signals, obtained from the temperature sensor, or the second signals, obtained from the pressure sensor, or the first signals and the second signals.

25. The dispensing unit according to claim 22, further comprising a source of the substance and wherein:
the controller is to adjust a position of the plug based on the first signals, obtained from the temperature sensor, or the second signals, obtained from the pressure sensor, or the first signals and the second signals; and
the pressure source is to deliver the substance from the source to the nozzle at a constant pressure.

26. A method of controlling flow of a substance through a nozzle, having a channel, terminating in an outlet, the channel, comprising a longitudinal symmetry axis, a sealing surface that is cylindrical, an internal tapered surface; and an alcove surface that is contiguous with the sealing surface, outwardly recessed relative to the internal tapered surface of the channel, and located between the sealing surface of the channel and the internal tapered surface of the channel, the method comprising:
moving a plug via a sleeve, fixed to the plug, along the channel of the nozzle to control flow of a substance through the nozzle;
positioning the plug, comprising a wall, along the channel via the sleeve such that the sealing surface of the channel prevents the substance from flowing through a first aperture that penetrates the wall of the plug through an outer surface of the wall;
positioning the plug along the channel such that the sealing surface of the channel prevents the substance from flowing through a portion of the first aperture in the wall of the plug; and
positioning the plug along the channel such that the first aperture of the plug, in its entirety, is facing the alcove surface and the substance flows across the alcove surface, located between the sealing surface of the channel and an internal tapered surface the outlet of the channel.

27. The method according to claim 26, further comprising controlling the position of the plug along the channel based on a temperature of the substance, located adjacent the alcove surface.

28. The method according to claim 26, further comprising controlling the position of the plug along the channel based on a pressure of the substance, located adjacent the alcove surface.

29. The method according to claim 26, further comprising delivering the substance to the nozzle at a constant pressure.

30. The method according to claim 26, further comprising:
determining a temperature of the substance, flowing through the nozzle; and
based on the temperature of the substance, moving the plug relative to the outlet of the nozzle to control a flow rate of the substance through the outlet of the nozzle.

31. The method according to claim 26, further comprising:
determining a pressure of the substance, flowing through the nozzle; and
based on the pressure of the substance, moving the plug relative to the outlet of the nozzle to control a flow rate of the substance through the outlet of the nozzle.

32. The method according to claim 26, further comprising positioning the plug to engage the internal tapered surface of the channel of the nozzle to prevent the substance from flowing through the outlet of the nozzle.

33. The method according to claim 26, further comprising delivering the substance through a bore of the sleeve toward the first aperture of the plug.

34. The method according to claim 26, further comprising changing a distance between a shoulder of the plug and the internal tapered surface of the channel of the nozzle to change a flow rate of the substance through the nozzle.

35. The method according to claim 26, further comprising moving the plug to different locations along the channel of the nozzle to change a flow rate of the substance through the nozzle.

36. The method according to claim 26, further comprising moving the plug away from the outlet of the nozzle to draw the substance, flowing out of the nozzle through the outlet, back into the nozzle.

37. The method according to claim 36, wherein moving the plug away from the outlet of the nozzle to draw the substance, flowing out of the nozzle through the outlet, back into the nozzle comprises moving the plug from a first position to a second position relative to the nozzle.

* * * * *